United States Patent [19]

Aguilar

[11] Patent Number: 4,640,546

[45] Date of Patent: Feb. 3, 1987

[54] ROCKER-RECLINER CHAIR

[76] Inventor: Henry Aguilar, 61 Garcia Ave., San Francisco, Calif. 94127

[21] Appl. No.: 814,286

[22] Filed: Dec. 24, 1985

Related U.S. Application Data

[63] Continuation of Ser. No. 577,416, Feb. 6, 1984.

[51] Int. Cl.[4] ..... A47C 3/02

[52] U.S. Cl. ..... 297/260; 5/108; 297/270

[58] Field of Search ..... 297/260, 270, 258; 5/108, 106

[56] References Cited

U.S. PATENT DOCUMENTS

| | | | |
|---|---|---|---|
| 89,317 | 4/1869 | Hursh | 297/258 |
| 710,035 | 9/1902 | Bergstrom | 297/258 |
| 920,298 | 5/1909 | Evans | 297/260 |
| 927,234 | 7/1909 | Haley | 297/270 |
| 1,168,276 | 1/1916 | Bendzsa | 5/106 |
| 1,983,207 | 12/1934 | Witzel | 297/270 |
| 3,392,723 | 7/1968 | Calvin | 5/108 |
| 3,548,810 | 12/1970 | Hoyer | 297/260 |

FOREIGN PATENT DOCUMENTS

| | | | |
|---|---|---|---|
| 2254471 | 7/1973 | Fed. Rep. of Germany | 297/284 |

*Primary Examiner*—Francis K. Zugel

[57] ABSTRACT

A rocker-recliner chair adapted to rock or pivot between a forward stable position in which the occupant's head is higher than his feet and a rearward unstable position in which his feet are higher than his head, or any intermediate unstable position under the control of the occupant. The center of gravity of the chair and the occupant is forward of the pivot axis so that the chair returns by force of gravity to the forward position and drive means and controls therefor are provided so that rocking between said positions is controlled to relatively slow, continuous, smooth movement, and may be varied to suit the occupant.

11 Claims, 7 Drawing Figures

ROCKER-RECLINER CHAIR

This is a continuation of co-pending application Ser. No. 06/577,416 filed on 02/06/84.

BACKGROUND OF THE INVENTION

This invention relates to a rocker-recliner chair, i.e., one in which the occupant may be supported in a generally reclining or semi-sitting position and which may rock or pivot between positions in which the feet of the occupant are lowered and elevated.

A traditional rocking chair is oscillated between forward and rearward positions by the movement of the occupant and is generally unstable and uncontrolled except by the actions of the occupant. Attempts to automate such rocking chairs have resulted in complicated and expensive equipment and, by and large, have not been successful in providing a smooth and controlled movement, particularly for elderly or infirm occupants.

SUMMARY OF THE INVENTION

The rocker-recliner chair of this invention provides smooth, controlled, relatively slow oscillation of a rocker-recliner chair which at all times is under the control of the occupant without requiring outside assistance or engagement with fixed supports such as the floor.

It has been found that such a gentle rocking movement between positions in which the occupant's head is at a higher elevation than his feet and in which his feet are elevated above his head is particularly conducive to improving the circulation in the lower extremities. The chair of this invention may be controlled to automatically operate between such positions at a very gradual rate such that the occupant will not be disturbed from reading or dozing by the movement of the chair.

It is therefore an object of this invention to provide a rocker-recliner chair that may be controlled by the occupant to operate automatically between forward or feet-down and rearward or feet-up positions.

It is another object of this invention to provide a rocker-recliner chair which is stable and will return to a feet-down position for entry and exit to and from the chair in the event of power failure or other interruption in the automatic operation of the chair.

It is still another object of this invention to provide a rocker-recliner chair which may be controlled by the occupant to rock at different rates, to pause in any position, or to gently return to the feet-down position under the control of the occupant.

Yet another object of this invention is the provision of a rocker-recliner chair which is automatically limited for movement between forward and rearward extremes selectable by the user.

DETAILED DESCRIPTION OF THE PREFERRED EMBODIMENT

Figure 1:
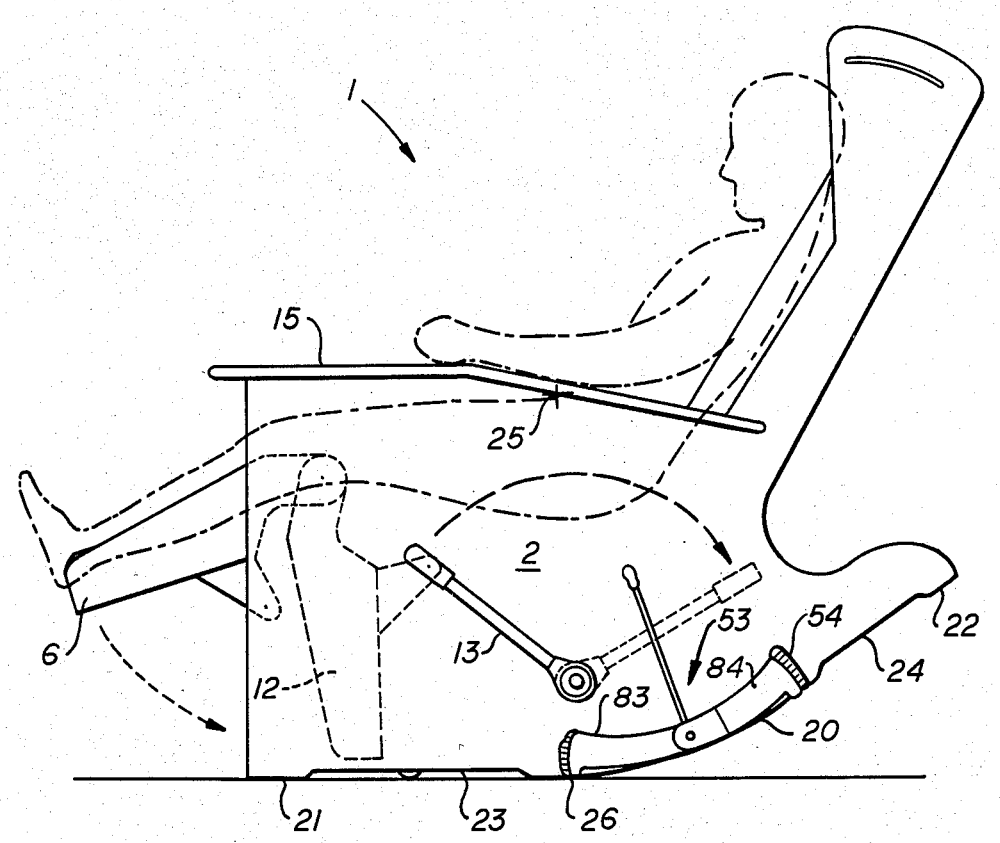
FIG. 1 is a side elevational view of a preferred embodiment of the chair of this invention in the forward stable position.

The embodiment of the invention described herein includes a typical chair, generally designated 1, (FIGS. 1 and 2) having a pair of opposed, generally vertically extending side frames 2, 3 connected by a seat portion 4 extending generally horizontally therebetween. Back portion 5 also extends between and is connected to side frames 2, 3 and is inclined upwardly and rearwardly from seat portion 4.

Extending forwardly from the forward end of seat portion 4 is an adjustable foot portion or rest 6 and extending upwardly and rearwardly from the upper edge of back portion 5 is an adjustable head portion or rest 7. As used herein "forward" and "front" refer to the direction of foot rest 6 and "rearward" and "back" refer to the direction of head rest 7.

As is typical with so-called "recliner" chairs, head rest 7 may be made adjustable as by pivoting its lower edge at 8 to side frames 2 and 3 and providing pins 9 at the upper end of head rest 7 extending into slots 10 on side frames 2 and 3 for positioning head rest 7 at different angles with respect to back portion 5.

Likewise, foot rest 6 may be supported on a linkage, generally designated 11 (FIG. 4), connected to side frames 2 and 3 so as to be movable between an upper position at generally the same level as seat 4 (FIG. 1) and a retracted position shown in phantom lines 12. An acutating lever 13 on the outside of one of the side frames connected to a shaft 14 from which linkage 11 extends is a convenient means for moving foot rest 6 between the retracted position for easy access to chair 1 and the upper position supporting the occupant's feet and legs in an elevated position.

Chair 1 may also be conveniently provided with arm rets 15 on the portions of side frames 2 and 3 above seat 4.

Figure 2:
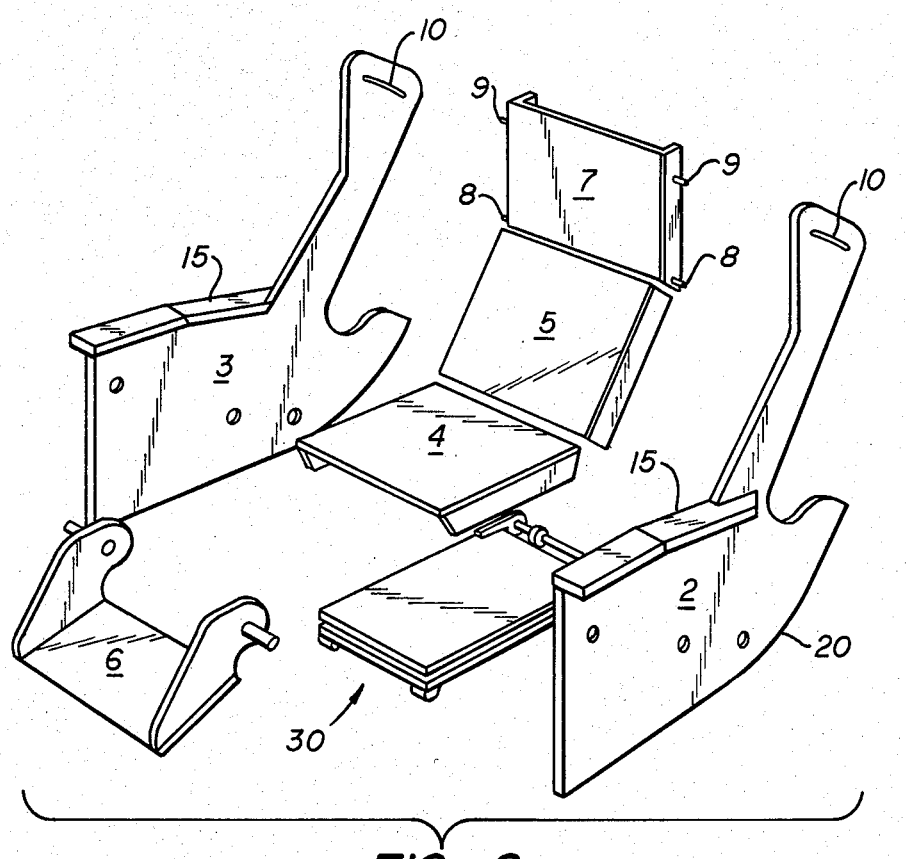
FIG. 2 is an exploded perspective view of the main parts of the chair of FIG. 1.

As thus far described, chair 1 provides a support configured to receive a human occupant with his buttocks and upper legs resting on seat 4, his back resting on back portion 5, his head resting on head rest 7 and his lower legs and feet supported on foot rest 6 in the elevated position shown in FIG. 1. In the embodiment shown in the drawings chair 1 is suspended for pivoting or rocking between a stable, forward position shown in FIG. 1 and an unstable, rearward position shown in FIG. 3.

The specific form of support shown is by configuring the lower portions of side frames 2, 3, as arcuate rockers 20 extending between forward and rear stop means in a forward, stable position as shown in FIG. 1, the chair rests on feet 21 and on forward portions of rockers 20. In a rearward, unstable position the chair rests on rearward portions of rockers 20. Feet 22 are provided as safety stops in case the chair is rocked too far back. In normal operation feet 22 do not touch the floor. Relieving the lower portions of side frames 2, 3 between the ends of rockers 20 and feet 21, 22, as at 23, 24, assures that the chair will rest on the forward ends of rockers 20 and feet 21 when in the forward position shown in FIG.

Figure 3:
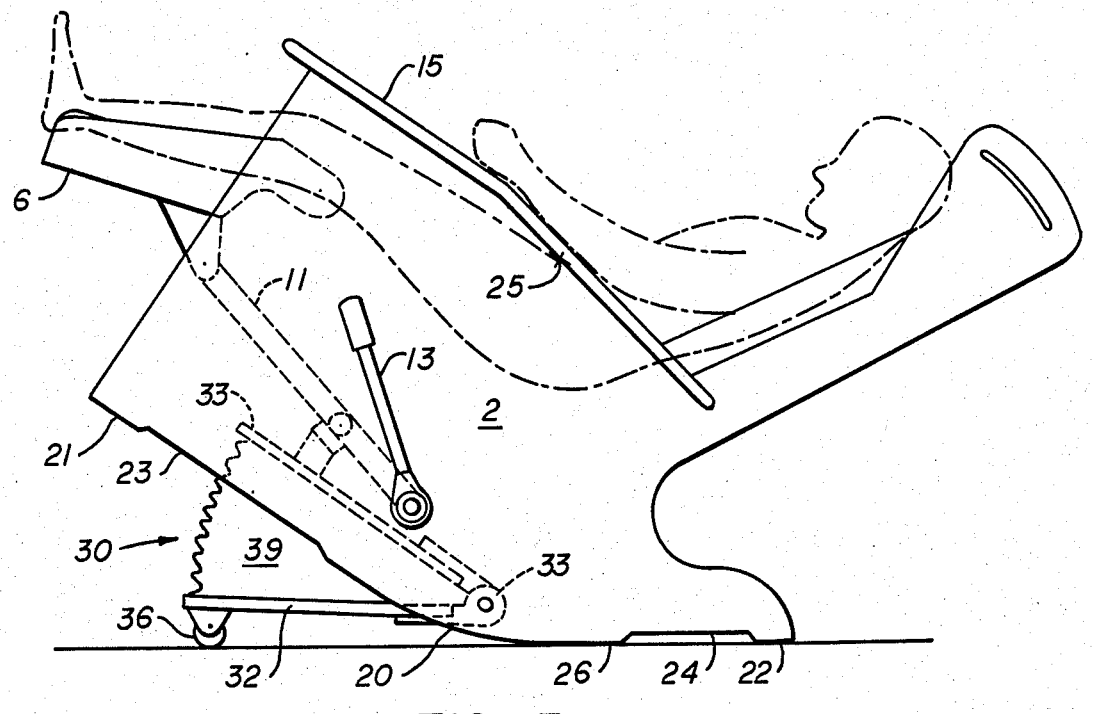
FIG. 3 is a side elecational view similar to FIG. 1 but with the chair shown in the rearward unstable position.

1 and on the rearward end of rockers 20 and feet 22 when in the rearward or elevated position shown in FIG. 3 no matter how uneven the surface on which the chair is resting.

In lieu of rockers 20, chair 1 may be suspended from a stationary frame resting on the floor or any other fixed means for pivoting about an axis extending transversely of frames 2, 3. In such case that axis may be fixed with respect to such side frames whereas in the form shown in the drawings the pivot axis will reside at the point at which rockers 20 engage the floor, through the forward ends of rockers 20 in the forward or lowered position shown in FIG. 1 to the rearward ends of rockers 20 in the rearward or elevated position of the chair shown in FIG. 3.

Chair 1 is configured and supported such that the combined center of gravity 25 of the chair and its occupant is always located slightly forward of a pivot axis of the chair, where the pivot axis is defined by a line passing through points 26 where the chair's rockers are engaging the floor at a particular moment. Such an arrangement ensures that the chair and its occupant will be urged by the force of gravity to return to or remain in the stable position shown in FIG. 1. It should also be noted that in the event chair 1 is supported or suspended for pivoting about a fixed axis stop means at the forward and rearward ends of the arc through which the chair pivots could takes forms and locations other than feet 21, 22.

It is preferable that the combined center of gravity 25 of chair 1 and its occupant is only a relatively small distance forward of the pivot axis of the chair sufficient for the force of gravity to overcome the resistance of the disabled chair elevating means, to be described, and friction so that descent of the chair to the forward position is relatively slow and smooth.

In accordance with the purpose of this invention such stop means are located so that in the lowered or forward position of the chair (FIG. 1) the occupant is supported in a semi-sitting or partial reclining position, that is with seat 4 and foot rest 6 in a generally horizontal orientation and back 5 and head rest 7 in a generally upright position, although slightly inclined rearwardly. The angles between seat 4, back 5, head rest 7, and foot rest 6 may, of course, be varied according to what is most comfortable for an occupant. In the position shown in FIG. 1, however, the occupant's feet and legs would normally be at a level below his chest and head. The stop means at the other end of the arc through which chair 1 rocks, such as feet 22, are located such that in the elevated or rearward position the occupant's legs are slightly above his chest and head.

Figure 4:
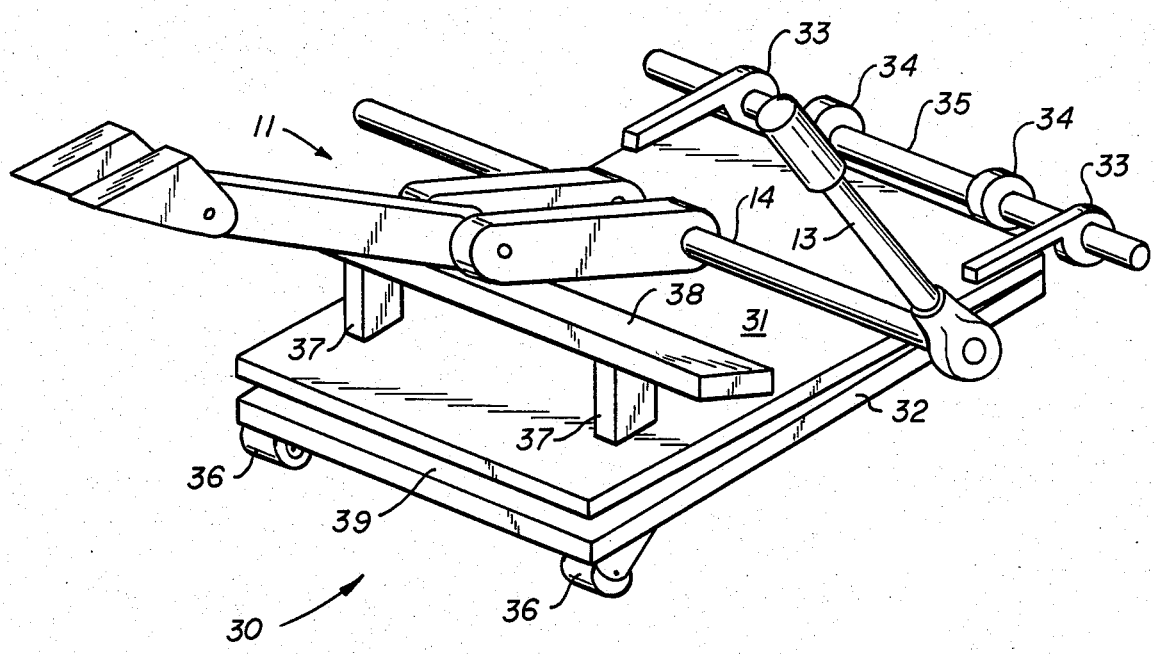
FIG. 4 is a perspective view of the operating mechanisms for the chair reclining means and for the foot rest.

One driving means, generally designated 30, for reclining chair 1 from the position shown in FIG. 1 to that of FIG. 3 is disclosed in FIG. 4. A pair of overlying, generally horizontally extending pads 31, 32 under seat portion 4 have their rear ends mounted for swinging independently of each other, as by bearings 33, 34, respectively journalled on transverse shaft 35 extending between and connected to side frames 2, 3. The forward end of lower pad 32 is provided with rollers 36 resting on the floor. While it is preferable to use pad 32 to keep the bellows from dragging on the floor as the chair is moved, it can be omitted such that the bellows rest directly on the floor.

Upper pad 31 supports posts 37 on its upper surfce, which posts depend from crossbar 38, the opposite ends of which are fixed to side frames 2, 3. As a consequence of this structure, it will be seen that spreading the forward ends of pads 31, 32 apart will cause the forward portions of said side frames, and therefore, chair 1 to be elevated thereby rocking the chair from the lowered position of FIG. 1 toward the rearward position of FIG. 3.

The preferred form of reclining or driving means to cause such spreading and elevating is an air-driven operator in the form of a pneumatic bellows 39 sandwiched between pads 31, 32. Upon inflation of the bellows 39 the forward end of pad 31 is swung upwardly away from pad 32 thereby elevating the forward portion of chair 1 causing it to pivot through the arc previously described about its pivot axis and rock toward the rearward position of FIG. 3.

Figure 6:
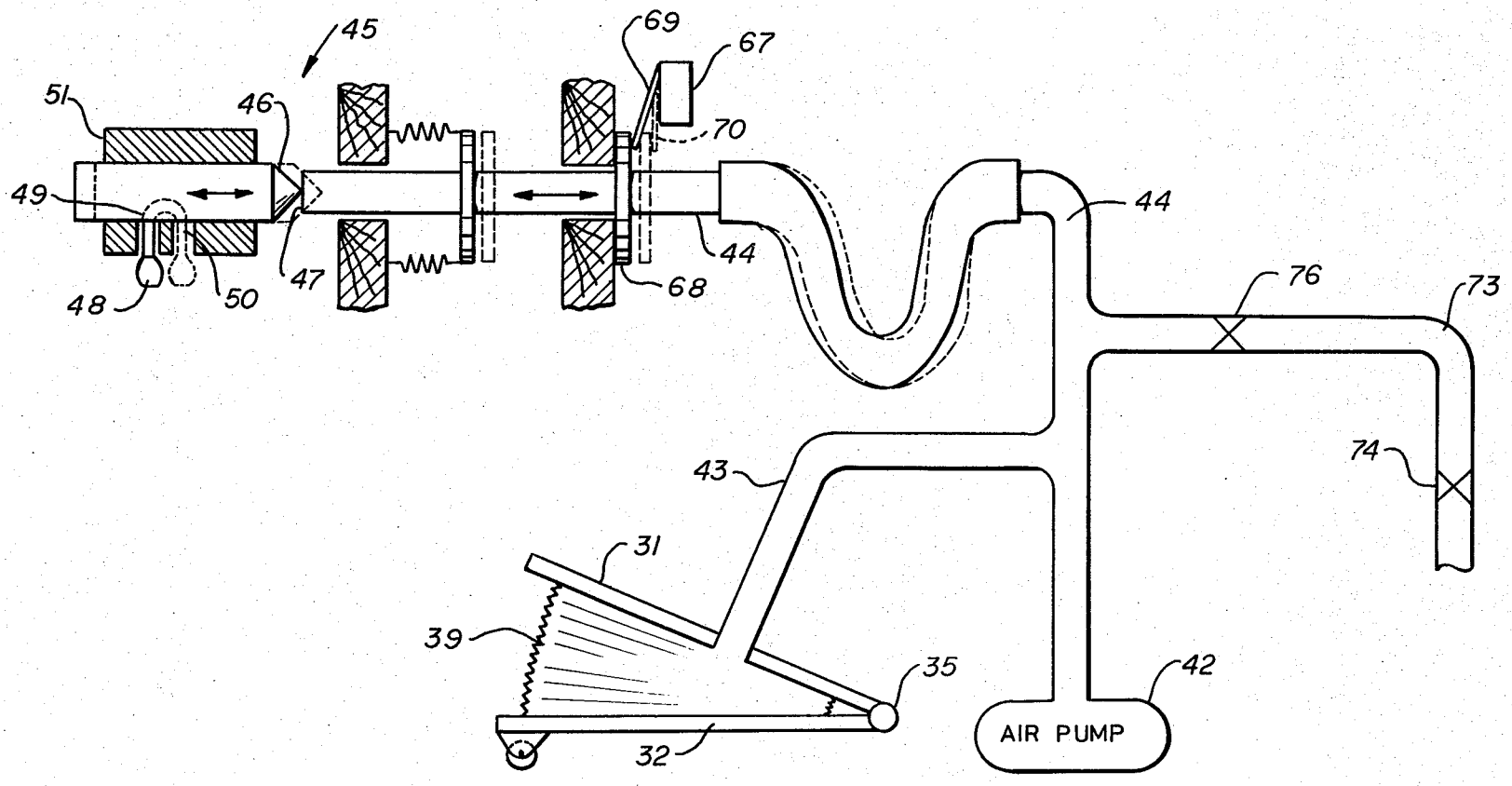
FIG. 6 is a schematic diagram of the pneumatic control system for the chair of FIG. 1.

Bellows 39 may be so inflated by connection to a suitable air source, such as small air pump 42 (FIG. 6) via conduit 43. In order to deflate bellows 39 to permit chair 1 to resume the forward position of FIG. 1, bellows 39 is also connected by air line 44 to a manual escape valve, generally designated 45. Such valve comprises a slidable closure member 46 adjacent the open end 47 of air line 44. Member 46 may be moved from the open position shown in solid lines in FIG. 6 to the dot-dash line position closing end 47 of line 44 by manipulating handle 48 from "open" notch 49 to "closed" notch 50 in the support 51 for closing member 46.

Thus far there has been described a manual system for rocking chair 1 rearwardly from the position of FIG. 1 by closing valve 45 which enables the elevating or reclining means 30 by permitting air source 42 to inflate bellows 39. As the chair reaches the rearward position of FIG. 3 or at any intermediate position, manipulating valve 45 to the open position shown in FIG. 6 disables the elevating means and causes the air to exhaust from bellows 39 to the atmosphere by virtue of the force of gravity tending to return chair 1 to the forward, stable position of FIG. 1.

Figure 5:
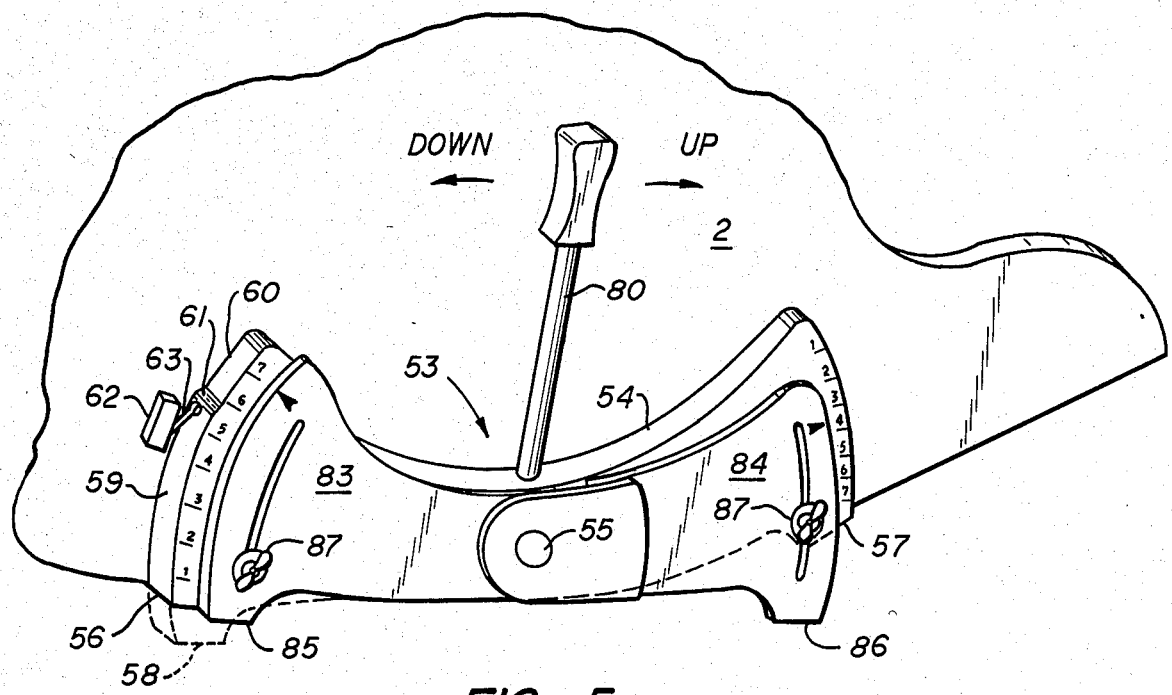
FIG. 5 is an enlarged side elevational view of the automatic movement limit and adjustment means of the chair of FIG. 1.

The controller, generally designated 53, for automatically controlling the operation of the chair 1 through an entire cycle is illustrated in FIG. 5. A double-ended rocker arm 54 is centrally pivoted to one of the side frames 2 of chair 1 as by pivot 55. Forward and rear limit feet 56, 57 project downwardly from the opposite ends of arm 54. When the chair is in the position of FIG. 1 foot 56 engages teh floor at the same horizontal level as foot 21 and foot 57 projects below the plane including foot 22 and the rear end of rocker 20 (FIG. 1).

As chair 1 reaches the extreme elevated or rearward position of FIG. 3, foot 57 engages the floor and is urged upwardly to a position coplanar with foot 22, therey rocking arm 54 about pivot 55 to swing foot 56 downwardly to the dot-dashed line position 58 projecting downwardly from the plane of foot 21. Of course the reverse movement of arm 54 occurs when the chair returns to the forward position of FIG. 1. Preferably pivot 55 secures arm 54 in sufficient frictional engagement with side frame 2 to retain arm 54 in either of its positions until it is moved to the other by the engagement of either foot 56 or 57 with the floor.

The forward edge of arm 54 is configured to a pair of arcuate cam surfaces 59, 60 formed about pivot 55 as a center with lower cam surface 59 being farther away from pivot 55 than cam surface 60. Transition portion 61 is formed between cam surfaces 59 and 60.

Direction control switch 62 (FIGS. 5, 7) is supported on frame 2 with its actuating arm 63 in contact with lower cam surface 59 adjacent to transition portion 61 with switch 62 closed in an "up" position when chair 1 is in the forward position illustrated in FIG. 1. THe cam surfaces on rocker arm 54 are configured such that, as the chair rocks backwardly, switch arm 63 continues to follow cam surface 59 maintaining switch 62 closed in the "up" position until the chair reaches the rearward position of FIG. 3. At that time the engagement of foot 57 with the floor rocks the forward end of arm 54 downwardly so that switch arm 63 trasverse from cam surface 59 across transition portion 61 onto the upper end of upper cam portion 60. In that orientation, switch 62 is closed to a "down" position.

Figure 7:
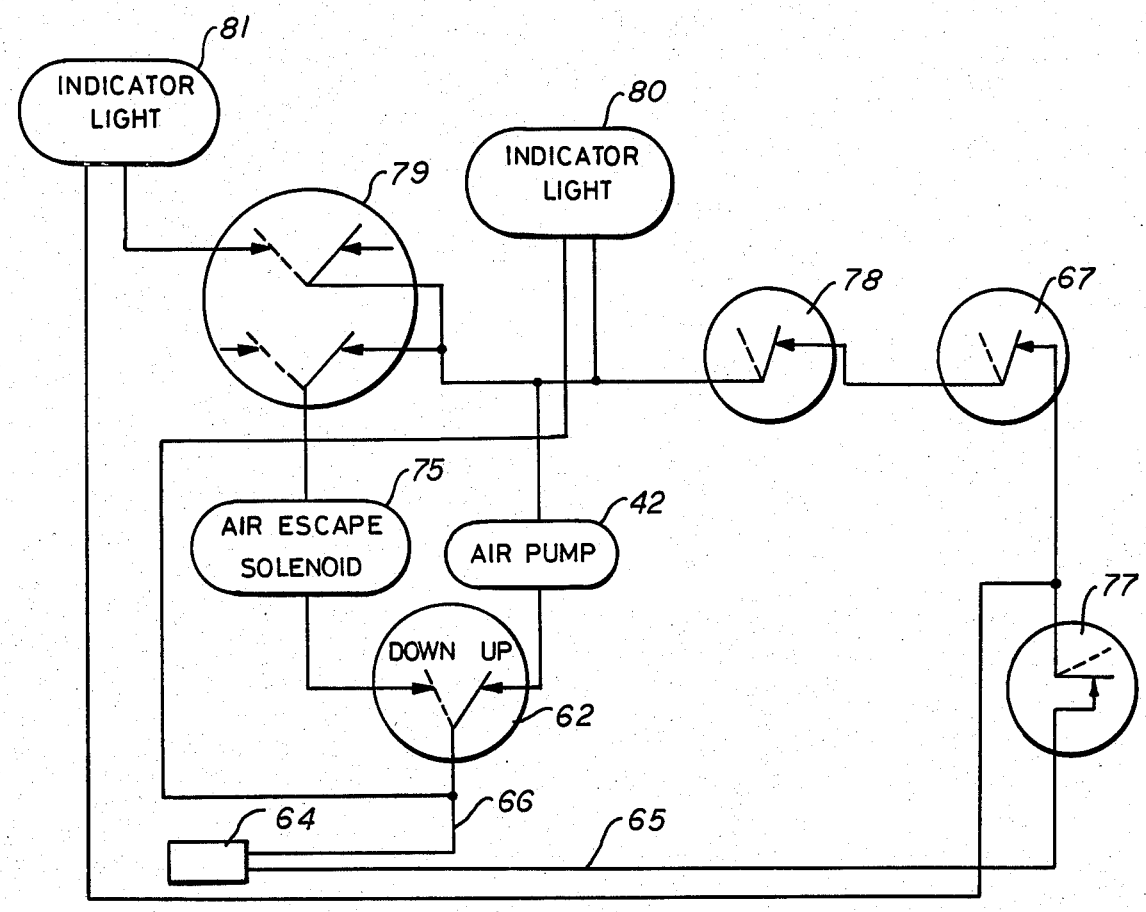
FIG. 7 is a schematic diagram of the electrical control circuit for the chair of FIG. 1.

Referring to FIG. 7, switch 62 is located in the main power circuit comprising a source of electrical power 64 with main power lines 65, 66. As shown in FIG. 7 air source 42, either a motor-driven pump or a solenoid actuated valve from an outside air source, is connected across lines 65, 66 via switch 62. When switch 62 is closed in the "up" position shown in solid line, power from source 64 actuates pump motor 42 thereby filling bellows 39 (FIGS. 3, 6) cuasing the front end of the chair to be elevated.

The electrical control circuit of FIG. 7 also includes a main "on-off" switch 67 for interrupting power to and thereby shutting down the entire system. Main switch 67 is opened or closed by operation of the manual handle 48 (FIG. 6) to the "closed" notch 50 which translates a portion of air line 44 carrying collar 68 into engagement with the operating arm 69 of switch 67 moving it to the dot-dash line position 70 closing switch 67.

Thus, as manual lever 48 is translated to the automatic "on" position in notch 50, manual escape valve 45 and switch 67 are both closed thereby initiating filling of bellows 39 by air source 42. The pneumatic circuit in FIG. 6 also includes an automatic air escape line 73 connected to the conduit 43 to bellows 39. A solenoid-operated air escape valve 74 serves to close line 73 to the atmosphere when said valve is closed and, likewise, permit the air in bellows 39 to exhaust through line 73 to the atmosphere when valve 74 is open.

The solenoid operator 75 for valve 74 (FIG. 7) is connected across power lines 65, 66 and maintains valve 74 in the normally closed condition when the solenoid is de-energized. Since solenoid 75 is connected in the circuit with direction control switch 62, when the chair reaches the limit of its rearward position (FIG. 3), switch 62 is closed to the "down" position as previously described, air source 42 discontinues providing air bellows 39, and solenoid 75 opens escape valve 74 permitting air to exhaust form the bellows and the chair to return by the force of gravity to the forward position of FIG. 1.

A manually-operated throttle valve 76 (FIG. 6) interposed in line 73 permits adjustment of the rate of air flow exhausting from said line and, therefore, the rate of descent or forward movement of the chair.

Power line 65 (FIG. 7) may also include a foot rest position switch 77 which is normally in the open position but is closed when foot rest 6 is in the elevated position (FIGS. 1, 3) in order to prevent the chair from rocking in the automatic mode with the foot rest retracted.

Additional control means may be provided by a pause switch 78 (FIG. 7) in power line 65. Switch 78 is normally closed but, when opened manually, interrupts the power to air source 42 or air escape solenoid 75, whichever is operative at the time, thereby causing the chair to maintain its then position until switch 78 is closed.

An automatic pause switch 79 (FIG. 7) may be interposed in power line 65 between the lines to air source 42 and air escape solenoid 75 in order to select an automatic pause in the cycle when the chair is in the fully elevated or feet-up position. Switch 79 is normally closed but when opened manually will interrupt the circuit to air escape solenoid 75, which circuit would normally be closed by translation of automatic control switch 62 to the "down" condition when chair 1 is at the rearward or elevated position illustrated in FIG. 3. Indicator lights 80, 81 may be respectively connected across switch 62 and across switch 79 to indicate respectively that the chair is in the fully automatic mode or is set to pause at its upper or rearward limit.

The direction of movement of the chair may be reversed at any point in the cycle by means of a manual lever 80 extending upwardly from rocker arm 54. If the chair is moving toward an elevated position, movement of lever 80 forwardly will cause conditioning of switch 62 to the "down" position via arm 63 contacting cam surface 60, and vice versa, as in the automatic mode.

Means for adjusting the upper and lower limits of movement of the chair may be provided by opposed individual rocker portions 83, 84 (FIG. 5). Such portions are each similar to and superimposed over the opposed portions of rocker arm 54 and are supported on pivot 55. The remote ends of portions 83, 84 are respectively provided with alternate limit feet 85, 86 the position of which with respect to feet 56, 57 may be vertically adjusted by virtue of arcuate slot and pin securement means 87. If forward rocker arm portion 83 is set so tht foot 85 projects below foot 56, movement of the chair to the forward stable position will be arrested before it reaches the position shown in FIG. 1 and correspondingly, positioning foot 86 below foot 57 will cause the chair to reverse from the elevating or reclining direction to the lowering or forward direction before it reaches the upper limit shown in FIG. 3.

The advantage of an air-driven operator for the chair elevating means is that it provides smooth, cushioned force, requires only a minimum or power to achieve operation of the chair, and is easily controllable as to rate of rocking, interruption or pause, and reversal of direction. The rate of elevation of the chair reclining means herein disclosed may be readily controlled by the common expedient of a controller or throttle valve for the air supply 42 and the rate of descent may be easily controlled by valve 76.

What is claimed is:

1. A rocker-recliner chair comprising:

a chair assembly having a seat surface configured to receive an occupant, and rocker surface adapted support said chair assembly on a floor surface such that said chair assembly may rock between a forward position and rearward position;

an inflatable and deflatable air-driven operator disposed between said chair assembly and said floor surface, said air-driven operator rocking said chair assembly rearwardly as it inflates and allowing said chair assembly to rock forwardly as it deflates;

forward sensing means provided proximate a forward portion of said rocker surface, said forward sensing means contacting said floor surface when said chair assembly is in said forward position;

rearward sensing means provided proximate a rearward portion of said rocker surface, said rearwrd sensing means contacting said floor surface when said chair assembly is in said rearward position;

inflation means coupled to said air-driven operator, said inflation means being responsive to said forward sensing means; and deflation means coupled to said air-driven operator, said deflation means being responsive to said rearward sensing means.

2. A rocker-recliner chair as recited in claim 1 further comprising a controller arm pivotally attached to said chair assembly proximate said rocker surface, where a forward portion of said controller arm provides said forward sensing means, and where a rearward portion of said controller arm provides said rearward sensing means.

3. A rocker-recliner chair as recited in claim 2 further comprising means for sensing the pivotal position of said controller arm, and operative to control the actions of said inflation means and said deflation means.

4. A rocker-recliner chair as recited in claim 3 further comprising a manually activated lever attached to said controller arm for manually pivoting said controller arm.

5. A rocker-recliner chair as recited in claim 3 further comprising means for adjusting the initial pivotal positions of said forward portion of said controller arm and said rearward portion of said controller arm to thereby adjust the limits of the forward and rearward rocking motion of said chair assembly.

6. A rocker-recliner chair as recited in claim 1 wherein said inflation means comprises an electrically powered air pump.

7. A rocker-recliner chair as recited in claim 5 wherein said air-driven operator comprises bellows and wherein said deflation means comprises a release valve.

8. A rocker-recliner chair as recited in claim 1 wherein the combined center of gravity of said chair assembly and said occupant is slightly forward of the point of contact between said rocker surface and said floor surface such that said chair assembly is slightly, but discernible, biased towards a forward position.

9. A rocker-recliner chair as recited in claim 1 further comprising inflation rate adjustment means for controlling the speed of operation of said inflation means.

10. A rocker-recliner chair as recited in claim 1 further comprising deflation rate adjustment means for controlling the speed of operation of said deflation means.

11. A rocker-recliner chair as recited in claim 1 further comprising means for selectively disabling said inflation means and said deflation means such that the position of the chair can be fixed at a user selectable position.

* * * * *

UNITED STATES PATENT AND TRADEMARK OFFICE

CERTIFICATE OF CORRECTION

PATENT NO. : 4,640,546

DATED : February 3, 1987

INVENTOR(S) : Henry Aguilar

It is certified that error appears in the above—identified patent and that said Letters Patent is hereby corrected as shown below:

Column 1, line 65, the word "elecational" should read - -elevational- -.

Column 2, lines 43-44, the words "arm rets 15" should read - -arm rests 15- -.

Column 2, lines 58-59, the words "and rear stop means in a forward, stable position" should read - -and rear stop means. In a forward, stable position- -.

Column 3, line 66, the words "on its upper surfce" should read - -on its upper surface- -.

Column 4, line 52, the word "therey" should read - -thereby- -.

Column 5, line 9, the word "trasverse" should read - -traverses- -.

Column 5, line 21, the word "cuasing" should read - -causing- -.

Column 5, lines 50-51, the words "providing air bellows 39" should read - -providing air to bellows 39- -.

UNITED STATES PATENT AND TRADEMARK OFFICE

CERTIFICATE OF CORRECTION

PATENT NO. : 4,640,546

DATED : February 3, 1987

INVENTOR(S) : Henry Aguilar

It is certified that error appears in the above—identified patent and that said Letters Patent is hereby corrected as shown below:

Column 5, line 52, the words "to exhaust form the bellows" should read - -to exhaust from the bellows- -.

Column 6, line 34, the words "so tht foot 85" should read - -so that foot 85- -.

Column 6, line 43, the words "a minimum or power" should read - -a minimum of power- -.

Claim 1, column 6, line 68, the words "said rearwrd" should read - -said rearward- -.

Signed and Sealed this

Twenty-first Day of April, 1987

*Attest:*

DONALD J. QUIGG

*Attesting Officer*

*Commissioner of Patents and Trademarks*